US006621056B2

(12) United States Patent
Sherrill

(10) Patent No.: US 6,621,056 B2
(45) Date of Patent: Sep. 16, 2003

(54) HEATER ASSEMBLY WITH A NON-UNIFORM CROSS SECTION

(75) Inventor: Jimmy Lee Sherrill, Cookeville, TN (US)

(73) Assignee: Tutco, Inc., Cookeville, TN (US)

( * ) Notice: Subject to any disclaimer, the term of this patent is extended or adjusted under 35 U.S.C. 154(b) by 103 days.

(21) Appl. No.: 09/986,568

(22) Filed: Nov. 9, 2001

(65) Prior Publication Data

US 2003/0089701 A1 May 15, 2003

(51) Int. Cl.[7] ..... H05B 3/06
(52) U.S. Cl. ..... 219/536; 392/379
(58) Field of Search ..... 219/532, 536, 219/537, 546, 539, 525; 392/379, 385; 28/611; 338/316

(56) References Cited

U.S. PATENT DOCUMENTS

| | | | | |
|---|---|---|---|---|
| 1,376,971 A | | 5/1921 | Qualman | |
| 1,490,088 A | | 4/1924 | Bridges | |
| 3,025,382 A | | 3/1962 | Eisele | |
| 3,670,143 A | * | 6/1972 | Zenz | 392/379 |
| 3,790,751 A | * | 2/1974 | Kuhn | 219/525 |
| 4,122,329 A | | 10/1978 | Godel | |
| 4,268,742 A | * | 5/1981 | Cottrell et al. | 219/532 |
| 4,309,595 A | | 1/1982 | Long et al. | |
| 4,332,080 A | * | 6/1982 | Bleckmann | 29/611 |
| 4,531,017 A | | 7/1985 | Sherrill | |
| 4,629,864 A | * | 12/1986 | Wilson | 392/385 |
| 4,647,757 A | | 3/1987 | Haastrup | |
| 4,656,340 A | * | 4/1987 | St. Louis | 219/532 |
| 4,667,086 A | * | 5/1987 | Keefe | 219/532 |
| 4,896,021 A | * | 1/1990 | Poweleit et al. | 392/379 |
| 5,329,098 A | | 7/1994 | Howard et al. | |
| 5,334,818 A | * | 8/1994 | Edwards et al. | 219/539 |
| 5,641,420 A | * | 6/1997 | Peterson et al. | 219/536 |
| 5,895,597 A | | 4/1999 | Sherrill | |
| 6,020,577 A | * | 2/2000 | Barker | 219/537 |
| 6,215,108 B1 | * | 4/2001 | Butcher et al. | 219/537 |
| 6,329,900 B1 | * | 12/2001 | Everett | 338/316 |

* cited by examiner

*Primary Examiner*—Teresa Walberg
*Assistant Examiner*—L Fastovsky
(74) *Attorney, Agent, or Firm*—Clark & Brody

(57) ABSTRACT

A heater assembly includes a housing structure, a support structure, an insulator structure, and a heating structure. The housing structure conveys heat to be produced within the housing structure from a first portion to a second portion of the housing structure. The support structure is releasably and fixedly secured to the housing structure. The insulator structure is affixed to the support structure to be releasably and fixedly secured to the housing structure. The heating structure is affixed to the insulator structure to be releasably and fixedly secured to the housing structure, and to be insulated from at least one of the housing structure and the support structure. The housing structure includes an outer surface having a non-uniform cross section with respect to an axis of the housing structure. The support structure, the insulator structure, and the heating structure are positioned within the housing structure.

49 Claims, 10 Drawing Sheets

HEATER ASSEMBLY WITH A NON-UNIFORM CROSS SECTION

FIELD OF THE INVENTION

The present invention relates in general to heater assemblies. In particular, the present invention relates to heater assemblies with a non-uniform cross section.

BACKGROUND OF THE INVENTION

It is known to use open, electric heater coils in tubes or ducts having a uniform cross section with respect to an axis of the tubes or ducts. Examples of known shapes of these tubes or ducts are round, square, rectangular and elliptical.

It is also known to use open, electric heater coils in heater housings or ducts having a uniform cross section with respect to an axis of the heater housings or ducts. Examples of known shapes of these heater housings or ducts are round and rectangular. These heater housings or ducts are used, for example, in clothes dryers.

It is also known how to position these electric heater coils, having a uniform cross section, along the length of the heater housing or duct having a uniform cross section as well. In essence, a metal plate or wire frame is used to retain electrical insulating standoffs that support the electric heater coils such that a spacing is maintained between electrical and heat producing parts and the surrounding heater housing or duct. The electrical insulating standoffs are made of electrical grade ceramic, and the heater housing or duct is made of metal.

It is, however, not known to use heater housings or ducts having a non-uniform cross section with respect to an axis of the heater housings or ducts, for example, in clothes dryers. It is, also, not known to use open, electric heater coils in heater housings or ducts having a non-uniform cross section with respect to an axis of the heater housings or ducts.

SUMMARY

One embodiment of the present invention provides a heater assembly, including a housing structure, a support structure, an insulator structure, and a heating structure. The housing structure conveys heat to be produced within the housing structure from a first portion to a second portion of the housing structure. The support structure is releasably and fixedly secured to the housing structure. The insulator structure is affixed to the support structure to be releasably and fixedly secured to the housing structure. The heating structure is affixed to the insulator structure to be releasably and fixedly secured to the housing structure, and to be insulated from at least one of the housing structure and the support structure. The housing structure includes an outer surface having a non-uniform cross section with respect to an axis of the housing structure. The support structure, the insulator structure, and the heating structure are positioned within the housing structure.

BRIEF DESCRIPTION OF THE DRAWINGS

In the drawings, like reference numerals represent similar parts of the illustrated embodiments of the present invention throughout the several views and wherein.

DETAILED DESCRIPTION

Figure 1:
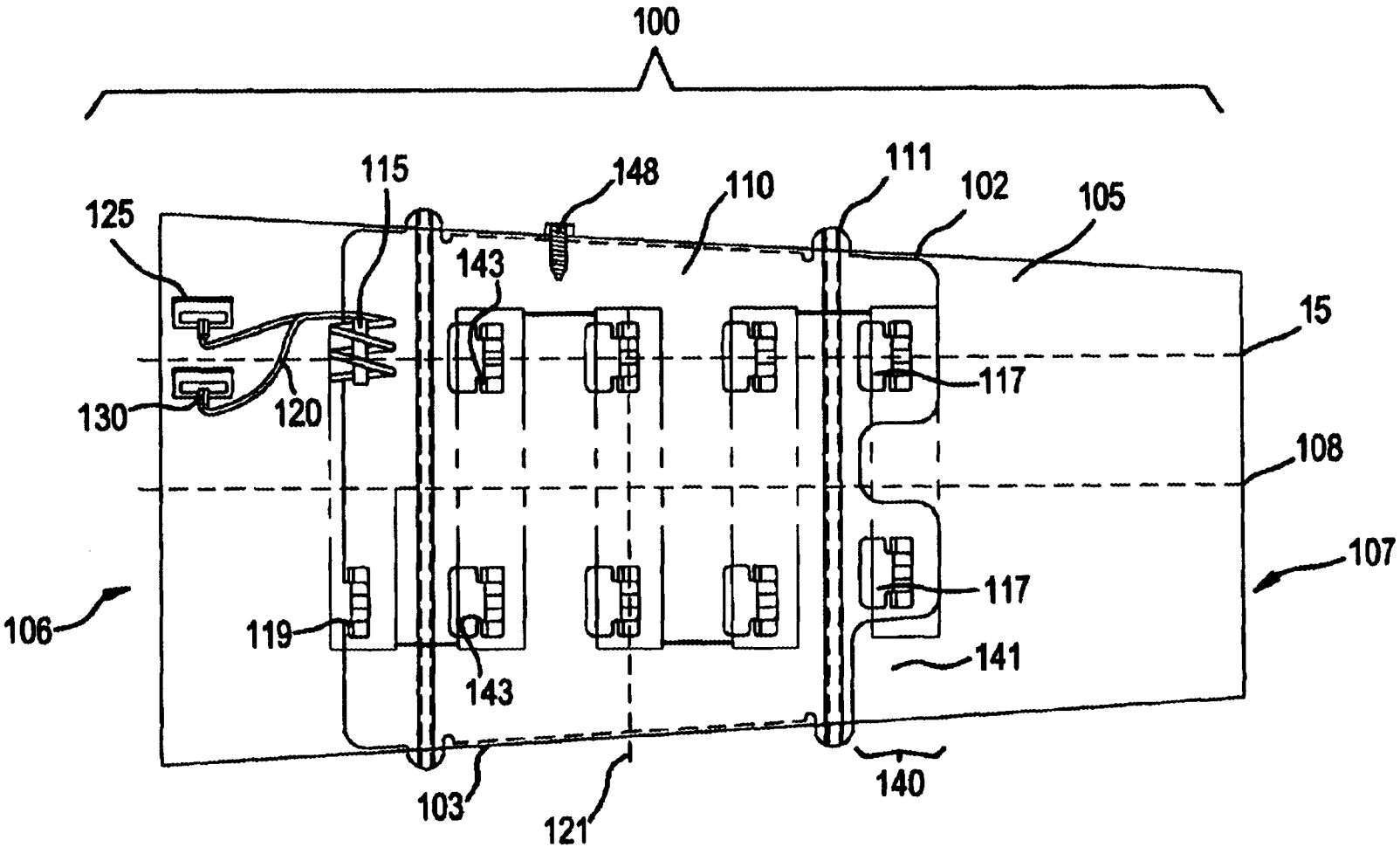
FIG. 1 is a cross-sectional, side view of an embodiment of a heater assembly.

FIG. 1 illustrates a cross-sectional, side view of an embodiment of a heater assembly 100. The heater assembly 100 may include a housing structure 105, a support structure 110, an insulator structure 115, and a heating structure 120.

Figure 2:
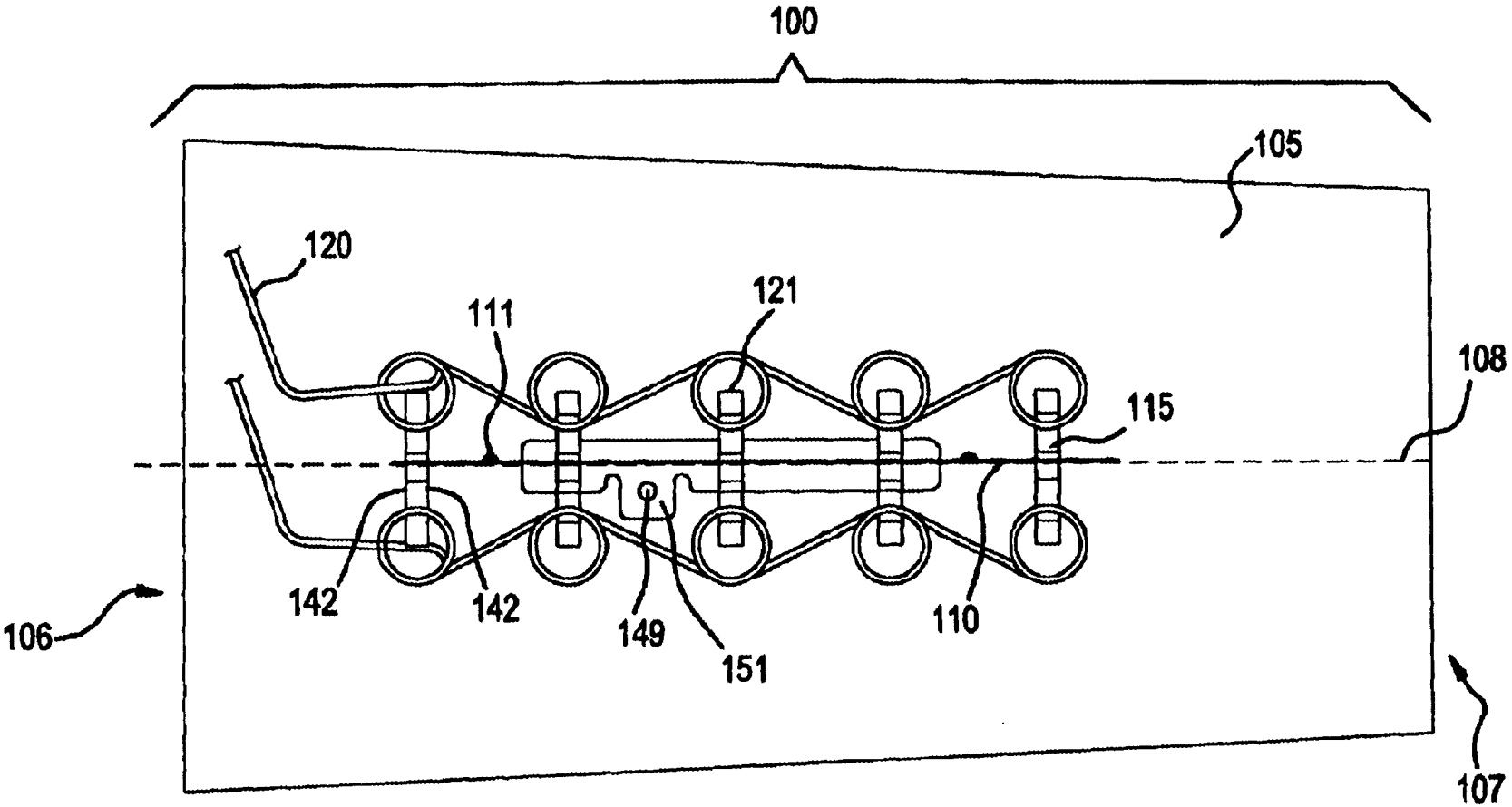
FIG. 2 is a cross-sectional, bottom view of the embodiment of FIG. 1.
Figure 4:
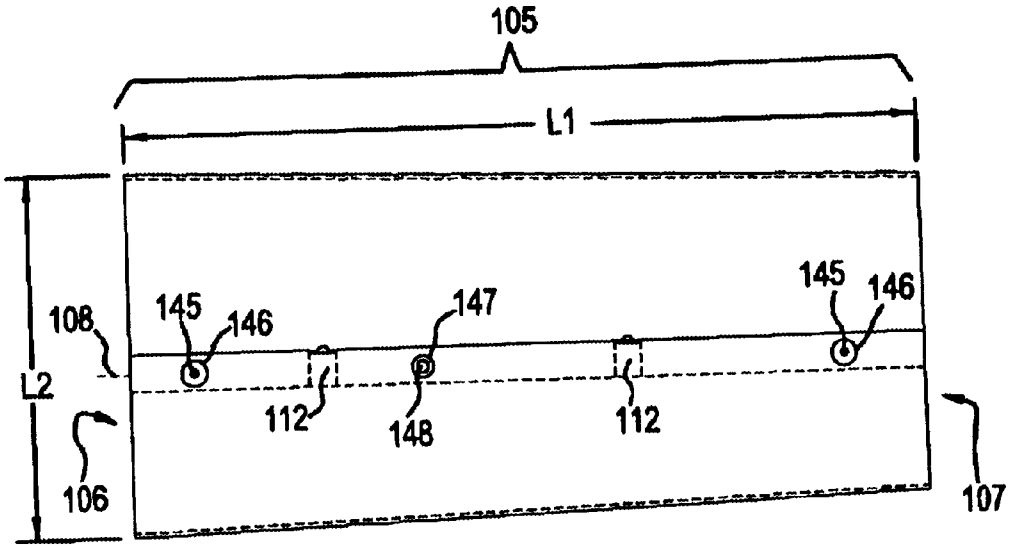
FIG. 4 is a top view of a housing structure in accordance with the embodiment of FIG. 1.
Figure 3:
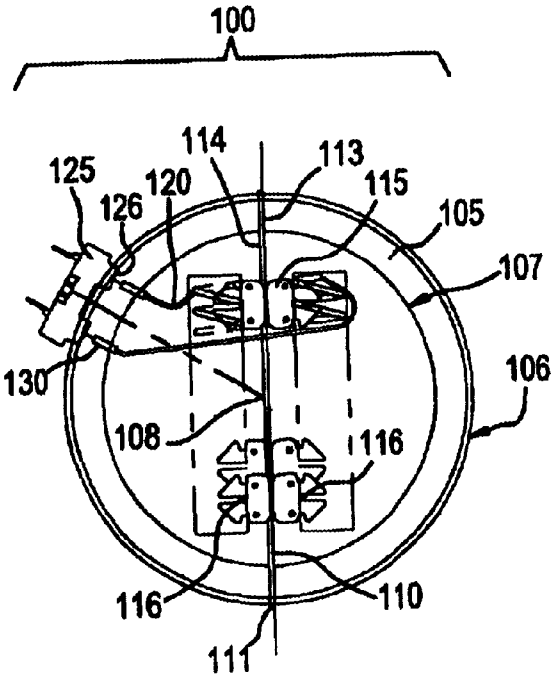
FIG. 3 is a cross-sectional, end view of the embodiment of FIG. 1.
Figure 6A:
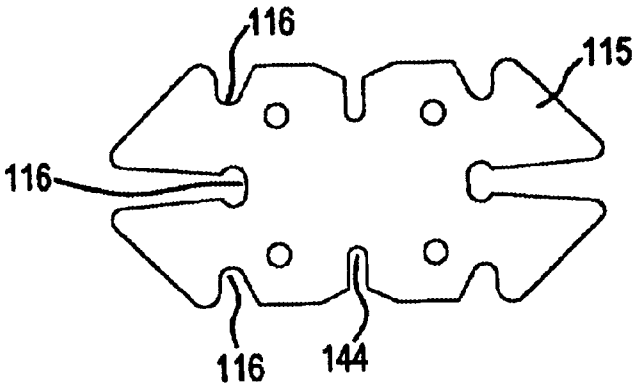
FIGS. 6A and 6B are a side view and a top view, respectively, of an insulator structure in accordance with the embodiment of FIG. 1.
Figure 6B:
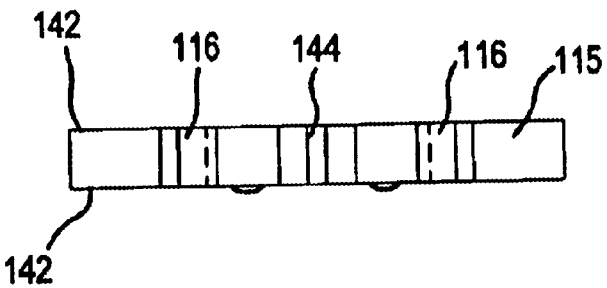
Figure 5:
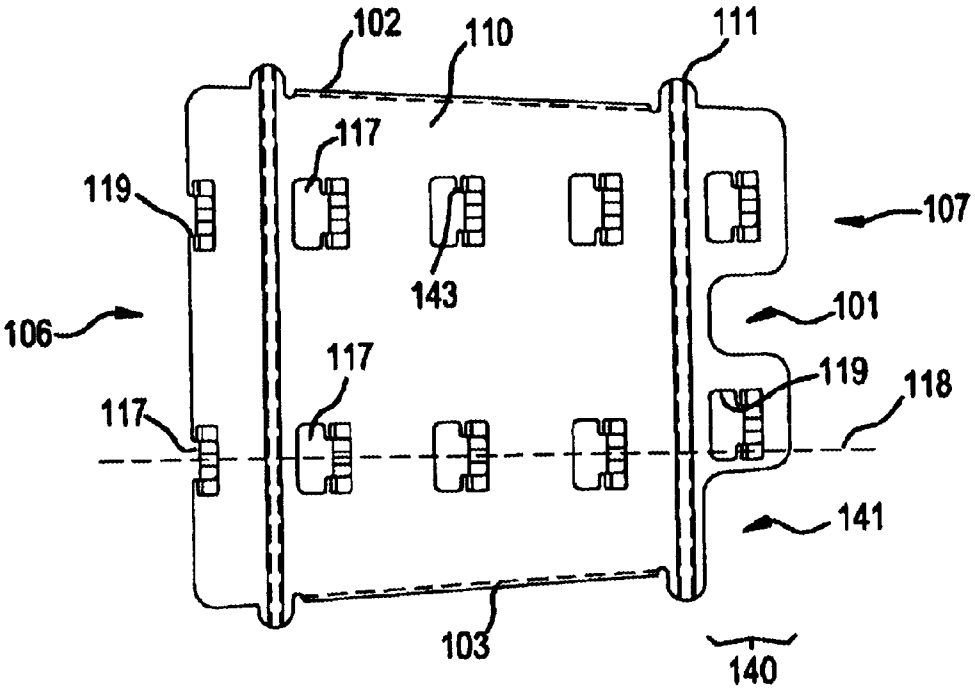
FIG. 5 is a side view of a support structure in accordance with the embodiment of FIG. 1.

FIG. 2 illustrates a cross-sectional, bottom view of the embodiment of FIG. 1, and FIG. 3 illustrates a cross-sectional, end view of the embodiment of FIG. 1. FIG. 4 illustrates a top view of the housing structure 105 in accordance with the embodiment of FIG. 1. FIG. 5 illustrates a side view of the support structure 110 in accordance with the embodiment of FIG. 1. FIGS. 6A and 6B illustrate a side view and a top view, respectively, of the insulator structure 115 in accordance with the embodiment of FIG. 1.

The housing structure 105 (see FIGS. 1–4) is constructed and arranged to convey heat to be produced within the housing structure 105 from a first portion (e.g., a first end portion 106) to a second portion (e.g., a second end portion 107) of the housing structure 105. The housing structure 105 includes an outer surface having a non-uniform cross section with respect to an axis 108 of the housing structure 105. The outer surface of the housing structure 105 may include a cone shaped cross section. FIG. 4 illustrates one embodiment of the size of the housing structure 105, namely, L1=12.000 in., L2=5.850 in., and L3=4.900 in. As such, the housing structure 105 may form a channel to direct air (e.g., heated air) flow in a longitudinal direction of the housing structure 105.

The housing structure 105 may be made of metal. For example, a metal sheet, having end portions, may include a plurality of fastener receiving openings 146 (see FIG. 4) formed therethrough adjacent to the end portions. To form the non-uniform cross section of the housing structure 105 with respect to the axis 108 of the housing structure 105, then the fastener receiving openings 146 at one end portion of the metal sheet are aligned with the fastener receiving openings 146 at the other end portion of the metal sheet, and a set of fasteners 145 (e.g., threaded bolts) is inserted through the fastener receiving openings 146. A set of threaded nuts may be threaded onto the ends of fasteners 145 inside the housing structure 105 and tightened to secure the one end portion of the metal sheet to the other end portion of the metal sheet. The fasteners 145 may include rivets.

The housing structure 105 may be oriented, for example, when secured to a dryer (e.g., gas and/or electric clothes dryer), such that the axis 108 of the housing structure 105 is at least one of horizontal and substantially horizontal. The support structure 110, the insulator structure 115, and the heating structure 120 may be positioned entirely or partially within the housing structure 105. The size, shape, material, and/or arrangement of the support structure 110, the insulator structure 115, the heating structure 120, and/or the housing structure 105 may be varied according to the preference of a user of the heater assembly 100.

The support structure 110 (see FIGS. 1–3, 5) is constructed and arranged to be releasably and fixedly secured to the housing structure 105. At least one of the housing structure 105 and the support structure 110 may include a projection for interlocking with the other of the housing structure 105 and the support structure 110 such that the support structure 110 is releasably and fixedly secured to the housing structure 105. The support structure 100 may be oriented to be about an axis (not shown) of the support structure 100 that is parallel and/or co-linear with respect to the axis 108 of the housing structure 105.

The projection of the support structure 110 may include a tab 111, and the projection of the housing structure 105 may include a tab receiving opening 112 (see FIG. 4), constructed and arranged to receive the tab 111. The tab 111 of the support structure 110 may be constructed and arranged to be inserted through the tab receiving opening 112 of the housing structure 105 and, once inserted, the tab 111 may extend through the tab receiving opening 112 to secure the support structure 110 to the housing structure 105, while accommodating expansion and contraction of the support structure 110 due to heating and cooling. The tab 111, for example, extending through the tab receiving opening 112 may not be bent and/or welded integrally with the housing structure 105. The support structure 110 may include four tabs 111, and four tab receiving openings 112.

The housing structure 105 includes a fastener receiving opening 147 formed therethrough. The support structure 110 includes an attachment portion 151 (see FIG. 2), which includes a corresponding fastener receiving opening 149 formed therethrough. To secure the support structure 110 to the housing structure 105, the attachment portion 151 of the support structure 110 is placed against a surface of the housing structure 105 with the fastener receiving openings 147, 149 in alignment, and a fastener 148 (e.g., threaded bolt) is inserted through the fastener receiving openings 147, 149. Then, a threaded nut (not shown) may be threaded onto the end of the fastener 148 inside the housing structure 105 and tightened to secure (e.g., without excessive looseness and vibration but permitting expansion and contraction due to heating and cooling) the attachment portion 151 of the support structure 110 to the interior of the housing structure 105, as well as to further secure the one end portion of the metal sheet to the other end portion of the metal sheet.

The support structure 110 may also include a first side portion 102 and a second side portion 103 (see FIG. 5), where at least one of the first side portion 102 and the second side portion 103 of the support structure 110 is constructed and arranged to abut the housing structure 105 (see FIG. 1). One of the first side portion 102 and the second side portion 103 of the support structure 110 may entirely abut the housing structure 105, where the other of the first side portion 102 and the second side portion 103 of the support structure 110 may partially abut the housing structure 105 (see FIG. 1).

The support structure 110 may include at least one of a first insulator structure receiving opening 117 and a second insulator structure receiving opening 117 (see FIGS. 1, 5), where each of the first insulator structure receiving opening 117 and the second insulator structure receiving opening 117 is constructed and arranged to receive the insulator structure 115. The first insulator structure receiving opening 117 and the second insulator structure receiving opening 117 may be oriented to be about an axis 118 (see FIG. 5) parallel with respect to the at least one of the first side portion 102 and the second side portion 103 of the support structure 110. Moreover, the first insulator structure receiving opening 117 and the second insulator structure receiving opening 117 may be oriented to be about an axis 150 (see FIG. 1) parallel with respect to the axis 108 of the housing structure 105. FIGS. 1 and 5 illustrate the support structure 110 including a plurality (e.g., ten) of insulator structure receiving openings 117.

The heat to be produced within the housing structure 105, for example, from the first portion (e.g., the first end portion 106) to the second portion (e.g., the second end portion 107) of the housing structure 105 may cause the second end portion 107 of the support structure 110 to experience thermal changes (e.g., significant thermal changes), and thus expansion and/or contraction. Without a thermal fatigue controller portion, a support structure may experience thermal fatigue cracks, for example, along sides of an insulator structure receiving opening, positioned adjacent to an end portion of the support structure. If sufficient growth of thermal fatigue cracks results on the support structure, then an insulator structure, initially secured by the insulator structure receiving opening, may become unsecured and unattached to the insulator structure receiving opening, resulting in failure of a heater assembly.

As such, the support structure 110 may include a thermal fatigue controller portion 140 (see FIGS. 1, 5) (e.g., contoured shape of a second end portion 107 of the support structure) to accommodate expansion and contraction of the support structure 110, for example, due to heating and cooling. The thermal fatigue controller portion 140 may be positioned to be adjacent to at least one of the first end portion 106 and the second end portion 107 of the support structure 110, and may include the insulator structure receiving opening 117 and a thermal fatigue controller opening 101. The thermal fatigue controller opening 101 may be a cut out portion of the support structure 110, and may be positioned between a set of insulator structure receiving openings 117, positioned within the thermal fatigue controller portion 140 of the support structure 110 (see FIGS. 1, 5). The insulator structure receiving opening 117 and the thermal fatigue controller opening 101 may be positioned to be adjacent to each other. Also, the thermal fatigue controller opening 101 may be positioned to be adjacent to at least one of the first side portion 102 and the second side portion 103 of the support structure 110. Moreover, the thermal fatigue controller opening 101 may be positioned to be between the first side portion 102 and the second side portion 103 of the support structure 110.

The insulator structure receiving opening 117 may include a side portion 119, which may be positioned adjacent to at least one of the first end portion 106 and the second end portion 107 of the support structure 110. As such, FIGS. 1 and 2 illustrate a pair of insulator structure receiving openings 117, positioned adjacent to the first end portion 106 of the support structure 110, having less than four side portions 119. As a result, the support structure 110 may be made using less material, and/or the support structure 110 may be constructed and arranged to not extend to at least one of the first end portion 106 and the second end portion 107 of the housing structure 105. The support structure 110, however, may be constructed and arranged to extend to at least one of the first end portion 106 and the second end portion 107 of the housing structure 105, according to the preference of the user of the heater assembly 100.

The insulator structure 115 (see FIGS. 1–3, 6) is affixed to the support structure 110 to be releasably and fixedly secured to the housing structure 105. At least one of the support structure 110 and the insulator structure 115 may include a projection for interlocking with the other of the support structure 110 and the insulator structure 115 such that the insulator structure 115 is affixed to the support structure 110 to be releasably and fixedly secured to the housing structure 105. The projection of the support structure 110 may include a tab 143 (see FIGS. 1, 5) (e.g., a bendable tab), and the projection of the insulator structure 115 may include a tab receiving opening 144 (see, for example, FIG. 6), which may be constructed and arranged to receive the tab 143 and/or a portion of the support structure 110. As such, the support structure 110 may releasably and fixedly secure the insulator structure 115, and accommodate expansion and contraction of the insulator structure 115 due to heating and cooling.

The insulator structure 115 may include a first heating structure receiving opening 116 and a second heating structure receiving opening 116 (see FIGS. 3, 6). The support structure 110 may include a first side portion 113 and a second side portion 114 (see FIG. 3). Then, at least one of the first heating structure receiving opening 116 and the second heating structure receiving opening 116 of the insulator structure 115 may be positioned to be adjacent to at least one of the first side portion 113 and the second side portion 114 of the support structure 110.

The insulator structure 115 may also include a side portion 142 (see FIGS. 2, 6B), which may be constructed and arranged to be oriented perpendicular to the axis 108 of the housing structure 105, for example, to facilitate assembly of the heating structure 120 to the insulator structure 115. Moreover, the side portion 142 of the insulator structure 115 may be constructed and arranged to be oriented centered about at least one of (i) the axis 150 parallel with respect to the axis 108 of the housing structure 105, and (ii) the axis 118 parallel with respect to the at least one of the first side portion 102 and the second side portion 103 of the support structure 110. The insulator structure 115 may be made of ceramic. Also, the insulator structure 115 may be positioned a sufficient distance from the housing structure 105 to accommodate movement (e.g., due to gravity) by the heating structure 120 during heating and/or cooling, and thus to prevent electrical and/or mechanical clearance problems.

The heating structure 120 (see FIGS. 1–3) is routed and affixed to the insulator structure 115 to be releasably and fixedly secured to the housing structure 105, and to be insulated from at least one of the housing structure 105 and the support structure 110. For example, the heating structure 120 may be affixed to at least one of the first heating structure receiving opening 116 and the second heating structure receiving opening 116 of the insulator structure 115 to be releasably and fixedly secured to the housing structure 105.

The heating structure 120 may include a resistive heating structure. In turn, the resistive heating structure may include a resistive heating coil. In turn, the resistive heating coil may be helical wound. An axis 121 (see FIG. 1) of the resistive heating coil, being helical wound, may be oriented perpendicular with respect to the axis 108 of the housing structure 105. The heating structure 120 may be coupled to a source of electric current such that the heating structure 120 may be heated, as current flows through the heating structure 120, to radiate energy. Then, a flow of air may be used to transfer the energy radiated from the heating structure 120 by conduction.

That is, the resistance heating coil may be pulled apart at selected points along its length and installed on the insulator structures 115 in vertical coil "passes" (see FIGS. 1–3), which may be oriented perpendicular with respect to a forced air flow to maximize the transfer of thermal energy from the resistance heating coil to the moving air flow. Any gravitationally induced movement of a pass of the resistance heating coil toward a surface of the housing structure 105 constructed and arranged to be adjacent to the second side portion 103 of the support structure 110 may be minimized or stopped by an insulator structure 105 constructed and arranged to be positioned adjacent to an end portion (e.g., bottom end portion) of at least one of the coil passes. The length of at least one of the coil passes may be varied depending on the position of the coil pass along the non-uniform cross section of the housing structure 105, with respect to the axis 108 of the housing structure 105.

As described above, a plurality of insulator structure receiving openings 117 may be oriented to be about the axis 150, which is parallel with respect to the axis 108 of the housing structure 105. FIG. 1 illustrates that the distance between the axis 150 and the first side portion 102 of the support structure 110 is greater near the first end portion 106 of the support structure 110 than near the second end portion 107 of the support structure 110. Once installed, the heater assembly 100 then may accommodate expansion and/or contraction of the heating structure 120, for example, due to heating and/or cooling by allowing the heating structure 120 to move (e.g., due to gravity) during contraction (or heating) such that the distance between the axis 150 and a surface of the housing structure 105, constructed and arranged to be adjacent to the first side portion 102 of the support structure 110, increases. As such, the heating structure 120 is constructed and arranged to move in a direction away from the surface of the housing structure 105, constructed and arranged to be adjacent to the first side portion 102 of the support structure 110, to prevent unintended contacts with other structures of the heater assembly 100.

The resistance heating coil may be positioned to be adjacent to the first side portion 113 and the second side portion 114 of the support structure 110. As such, the support structure 110 may include a heating structure transitioning opening 141 (see FIG. 5), which may be constructed and arranged to transition the heating structure 120 from adjacent to one of the first side portion 113 and the second side portion 114 of the support structure 110 to adjacent to the other one of the first side portion 113 and the second side portion 114 of the support structure 110. The resistance heating coil may be opened (e.g., unwound) at a center portion such that the transition may be made from one side portion of the support structure 110 to the other side portion of the support structure 110, for example, with sufficient electrical and/or mechanical clearance to the support structure 110. The heating structure transitioning opening 141 may be positioned to be adjacent to at least one of the first end portion 106 and the second end portion 107 of the support structure 110. Also, the heating structure transitioning opening 141 may be positioned to be adjacent to at least one of the first side portion 102 and the second side portion 103 of the support structure 110. Moreover, the heating structure transitioning opening 141 may be positioned to be between the first side portion 102 and the second side portion 103 of the support structure 110.

The heating structure transitioning opening 141, for example, may be positioned to be adjacent to the second side portion 103 of the support structure 110 such that movement due to gravity by the heating structure 120, positioned within the thermal fatigue controller portion 140, may be away from a surface of the housing structure 105, positioned adjacent to the first side portion 102 of the support structure 110. Sufficient distance may be provided between the heating structure 120, positioned within the heating structure transitioning opening 141, and a surface of the housing structure 105, positioned adjacent to the second side portion 103 of the support structure 110 to accommodate movement of the heating structure 120, for example, due to gravity.

Figure 7A:
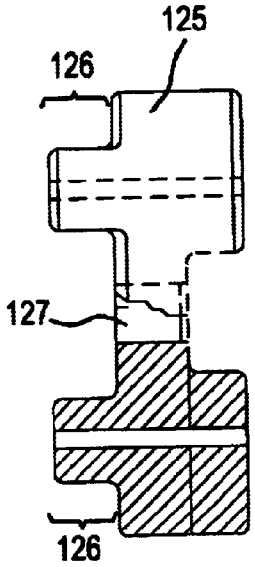
FIGS. 7A, 7B and 7C are a top view, a front view and a rear view, respectively, of a terminal block structure in accordance with the embodiment of FIG. 1.
Figure 7B:
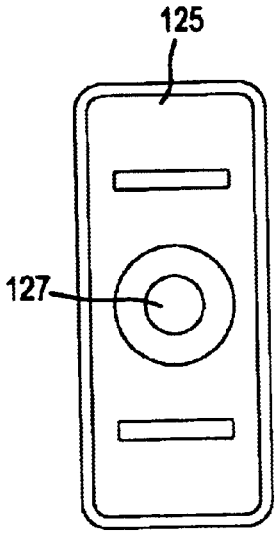
Figure 7C:
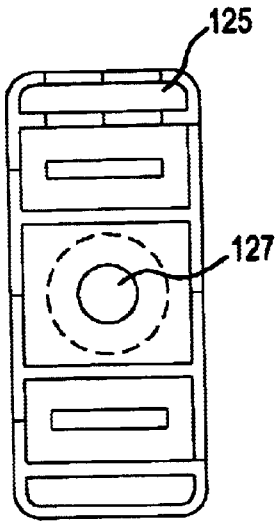
Figure 8:
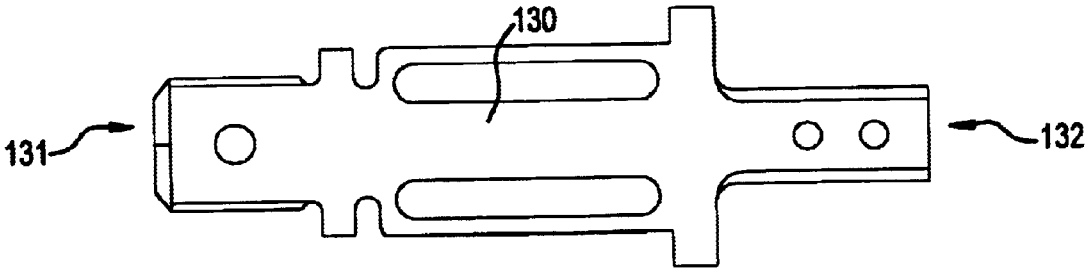
FIG. 8 is a top view of a terminal structure in accordance with the embodiment of FIG. 1.

The heater assembly 100 (see FIGS. 1, 3) may further include a terminal block structure 125 and a terminal structure 130. FIGS. 7A, 7B and 7C illustrate a top view, a front view and a rear view, respectively, of the terminal block structure 125 in accordance with the embodiment of FIG. 1. FIG. 8 illustrates a top view of the terminal structure 130 in accordance with the embodiment of FIG. 1.

The terminal block structure 125 (see FIGS. 1, 3, 7) (e.g., insulator terminal block) is constructed and arranged to be releasably and fixedly secured to the housing structure 105, and to retain the terminal structure 130 in position. The terminal block structure 125 may be positioned to be adjacent to at least one of the first end portion 106 and the second end portion 107 of the housing structure 105. As such, the terminal block structure 125 may be constructed and arranged to be a sufficient distance away from the support structure 110 (see FIG. 1), for example, to allow the terminal block structure 125 and/or the end (straight) portions of the heating structure 120 (which may be energized) not to be interfered with by the surface of the support structure 110 (e.g., to avoid contact with the support structure 110) and/or the metal of the support structure 110 (e.g., to avoid a short circuit with the support structure 110). It is, for example, easier to route the end portions of the heating structure 120 toward the terminal block structure 125 without interference from the support structure 110.

At least one of the terminal block structure 125 and the housing structure 105 may include a projection for interlocking with the other of the terminal block structure 125 and the housing structure 105 such that the terminal block structure 125 is releasably and fixedly secured to the housing structure 105. The projection of the terminal block structure 125 may include a tab 126 (see FIGS. 3, 7A), and the projection of the housing structure 105 may include a tab receiving opening (see FIGS. 1, 3), which may be constructed and arranged to receive the tab 126.

The housing structure 105 may also include a fastener receiving opening (not shown) formed therethrough, and positioned thereon (see, for example, FIG. 3) according to the preference of a user of the heater assembly 100. The terminal block structure 125 may also include a corresponding fastener receiving opening 127 (see FIG. 7) formed therethrough. To secure the terminal block structure 125 to the housing structure 105, a surface of the terminal block structure 125 is placed against a surface of the housing structure 105 with the fastener receiving openings in alignment, and a fastener (e.g., threaded bolt, rivet) (not shown) is inserted through the fastener receiving openings. Then, a threaded nut (not shown) may be threaded onto the end of the fastener inside the housing structure 105 and tightened to secure the terminal block structure 125 to the housing structure 105.

The terminal structure 130 (see FIGS. 1, 3, 8), having a first end 131 and a second end 132, is coupled to the heating structure 120 at the first end 131 of the terminal structure 130 and to the terminal block structure 125 at the second end 132 of the terminal structure 130. The heater assembly 100 may include, for example, a set of terminal structures 130 such that a terminal structure 130 may be coupled to each end of the heating structure 120.

Another embodiment of a heater assembly 100 may include a housing structure 105, an insulator support structure, and a heating coil 120 (such as, for example, illustrated in FIGS. 1–6). The housing structure 105 may convey heat to be produced within the housing structure 105 from a first portion (e.g., first end portion) to a second portion (e.g., second end portion) of the housing structure 105. The housing structure 105 may include a first area at the first portion of the housing structure 105 and a second area at the second portion of the housing structure 105, where one of the first area and the second area is a larger area than the other one of the first area and the second area. The housing structure 105 may also include an outer surface having a cone shaped cross section, and may be oriented, for example, when secured to a dryer (e.g., clothes dryer) such that an axis 108 of the housing structure 105 is at least one of horizontal and substantially horizontal.

The insulator support structure may be releasably and fixedly secured to the housing structure. The insulator support structure may include a support structure 110 and an insulator structure 115. As such, the support structure 110 may be releasably and fixedly secured to the housing structure 105, and the insulator structure 115 may be affixed to the support structure 110 to be releasably and fixedly secured to the housing structure 105.

The heating coil 120 may be affixed to the insulator support structure to be releasably and fixedly secured to the housing structure 105, and to be insulated from the housing structure 105. The heating coil 120 may be helical wound, and an axis 121 of the heating coil 120 may then be oriented to be perpendicular with respect to the axis 108 of the housing structure 105. The insulator support structure and the heating coil 120 may be positioned entirely or partially within the housing structure 105.

An embodiment of a method for assembling a heater 100 (such as, for example, illustrated in FIGS. 1–8) is provided. The method affixes an insulator structure 115 to a support structure 110, and affixes a heating structure 120 to the insulator structure 115. The method then secures the support structure 110 to a housing structure 105. The support structure 110, the insulator structure 115, and the heating structure 120 may be releasably and fixedly secured to the housing structure 105, and may be positioned entirely or partially within the housing structure 105. The method may simply roll a portion of heat conducting material (e.g., metal), for example, using a rolling tool, to form the housing structure 105. The housing structure 105 may be made of metal.

The insulator structure 115 may insulate the heating structure 120 from at least one of the housing structure 105 and the support structure 110. The housing structure 105, including an outer surface having a non-uniform cross section with respect to an axis 108 of the housing structure 105, may convey heat to be produced within the housing structure 105 from a first portion to a second portion of the housing structure 105. The outer surface of the housing structure 105 may include a cone shaped cross section.

The heating structure 120 may include a resistive heating coil, which may be helical wound. An axis of the resistive heating coil, being helical wound, may be oriented to be perpendicular with respect to the axis 108 of the housing structure 105.

The method may also secure a terminal block structure 125 to at least one of the housing structure 105 and the support structure 110, and couple a terminal structure 130, having a first end and a second end, to the heating structure 120 at the first end of the terminal structure 130 and to the terminal block structure 125 at the second end of the terminal structure 130. The terminal block structure 125 may be releasably and fixedly secured to the housing structure 105 and/or the support structure 110.

Thus, the described embodiments of a heater assembly may include a housing having a non-uniform cross section with respect to an axis of the housing, for example, to be used in dryers (e.g., clothes dryer). Such a heater housing may be configured to be compatible, for example, in both gas and electric clothes dryer. As such, the amount of compatible parts between gas and electric clothes dryers is increased, which reduces costs for manufacturers of both gas and electric dryers. Also, the described embodiments of the heater assembly may include a open, electric heater coil in the housing having the non-uniform cross section with respect to the axis of the housing.

Figure 9:
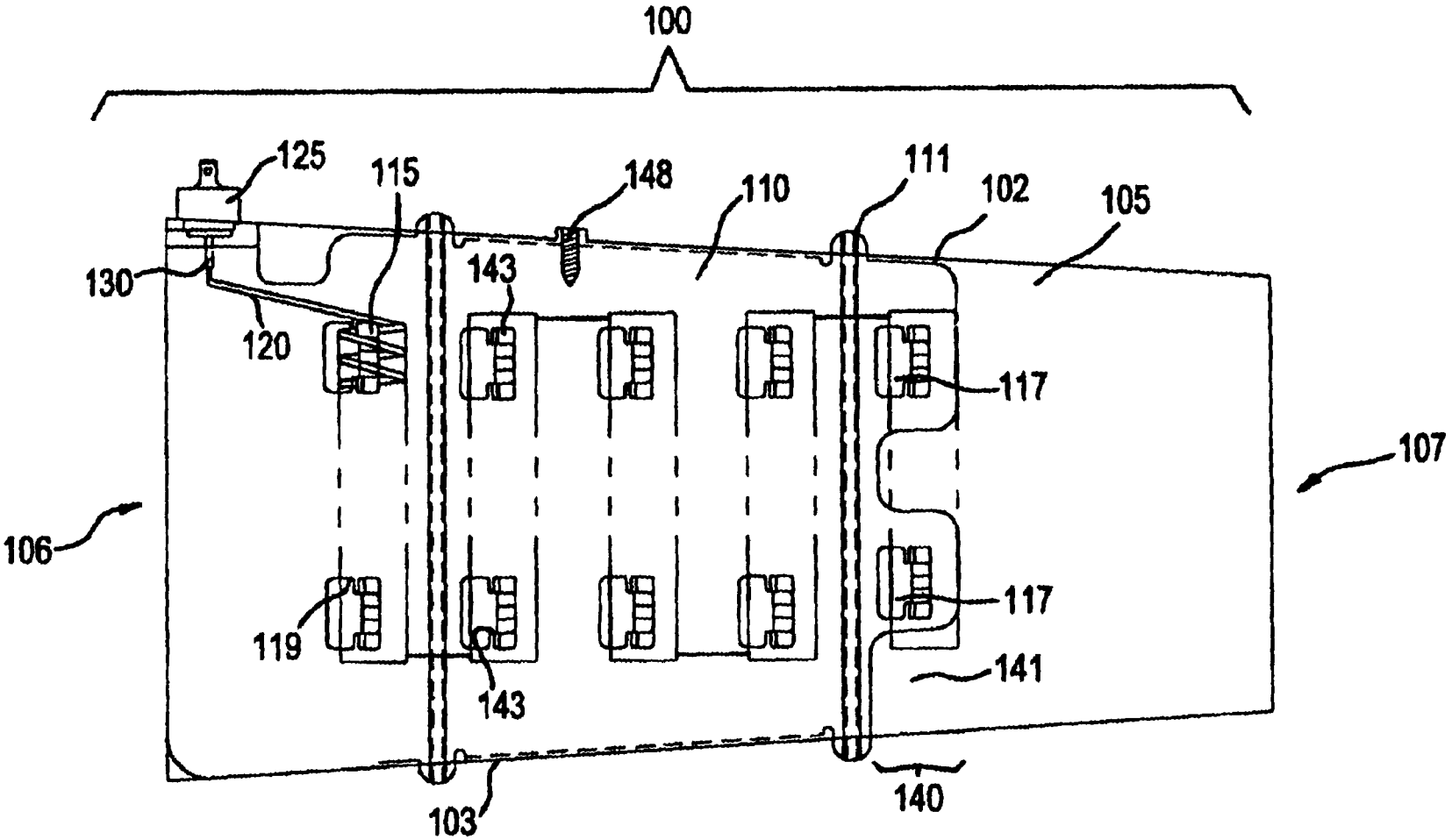
FIG. 9 is a cross-sectional, side view of another embodiment of a heater assembly.
Figure 10:
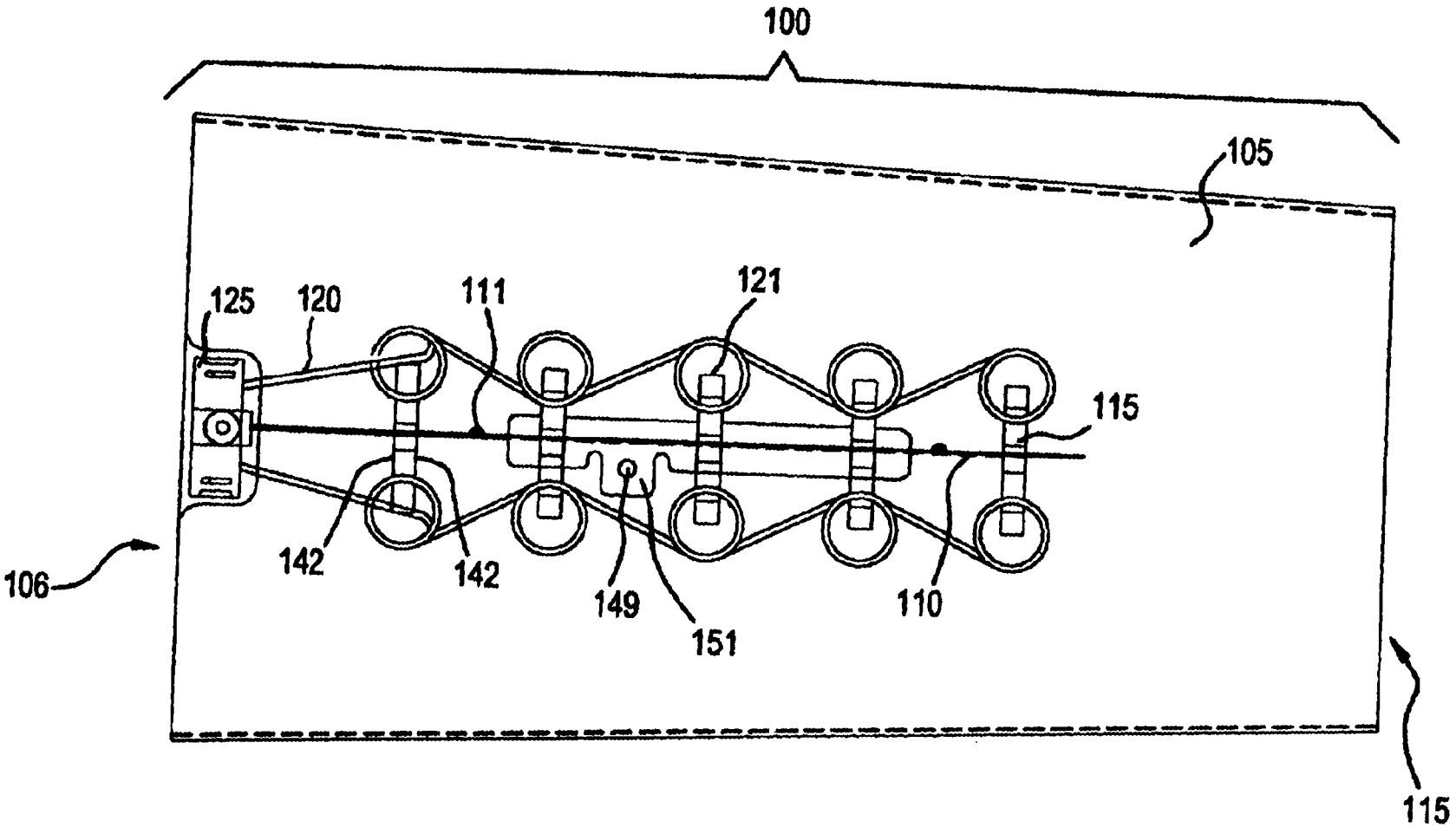
FIG. 10 is a cross-sectional, bottom view of the embodiment of FIG. 9.
Figure 12:
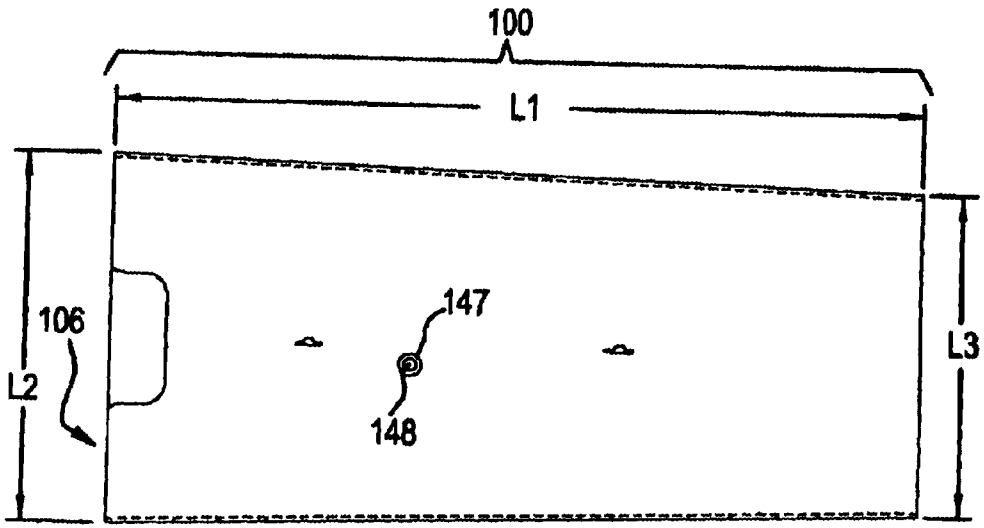
FIG. 12 is a top view of a housing structure in accordance with the embodiment of FIG. 9.
Figure 11:
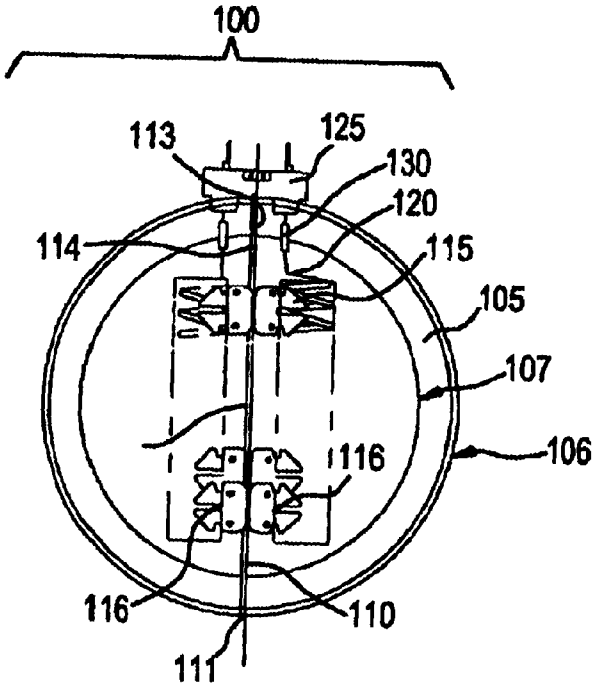
FIG. 11 is a cross-sectional, end view of the embodiment of FIG. 9.
Figure 13B:
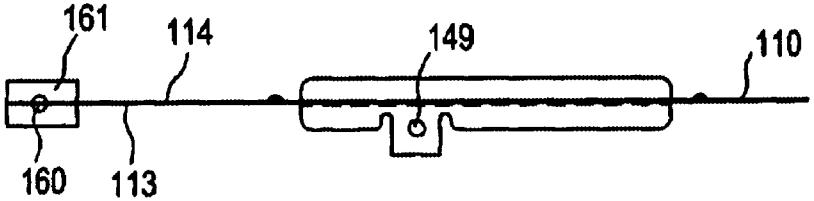
FIGS. 13A and 13B are a side view and a top view, respectively, of a support structure in accordance with the embodiment of FIG. 9.
Figure 13A:
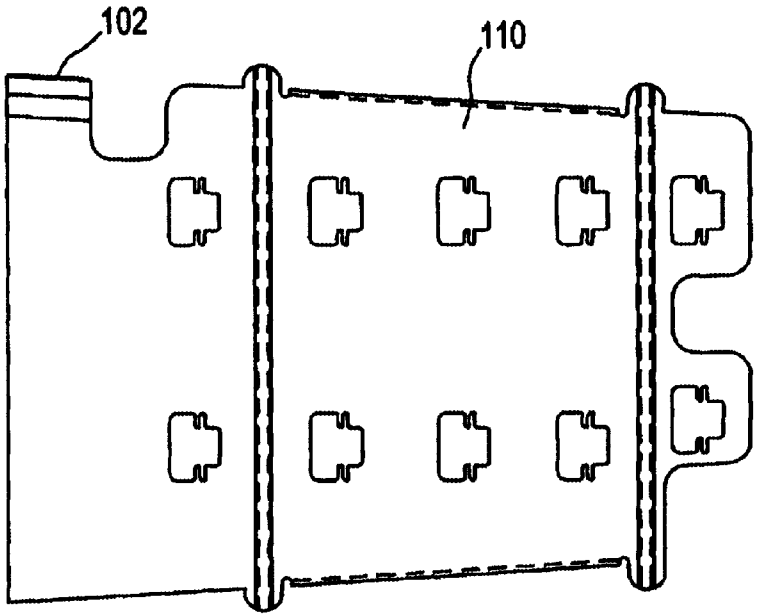

FIG. 9 illustrates a cross-sectional, side view of another embodiment of a heater assembly 100. FIG. 10 illustrates a cross-sectional, bottom view of the embodiment of FIG. 9. FIG. 11 illustrates a cross-sectional, end view of the embodiment of FIG. 9. FIG. 12 illustrates a top view of a housing structure 105 in accordance with the embodiment of FIG. 9. FIGS. 13A and 13B illustrate a side view and a top view, respectively, of a support structure 110 in accordance with the embodiment of FIG. 9. In FIGS. 1–13, however, like reference numerals represent similar parts of the illustrated embodiments, and the generic principles presented herein may be applied to the illustrated embodiment of FIGS. 9–13.

FIG. 9, however, illustrates the support structure 110 extending to the first end portion 106 of the housing structure 105 (cf. FIG. 1). FIGS. 9 and 10, also, illustrate the terminal block structure 125 releasably and fixedly secured to the support structure 110, and may be positioned to be adjacent to the first side portion 102 of the support structure 110 (cf. FIG. 3). As such, the insulator structure 115, the heating structure 120, the terminal block structure 125, and/or the terminal structure 130 may be assembled onto the support structure 110 separately from the housing structure 105. The support structure 100, once assembled as such, may then be assembled into the housing structure 105 to form the heater assembly 100. FIGS. 9–11, furthermore, illustrate the terminal block structure 125 positioned to be adjacent to the first end portion 106 of the housing structure 105. The housing structure 105 may include a terminal block receiving opening to receive the terminal block structure 125 (see FIG. 12).

The support structure 110 may include a tab 161 having a fastener receiving opening 160 (see FIG. 13B) formed therethrough. The terminal block structure 125 may include a corresponding fastener receiving opening 127 (see FIG. 7) formed therethrough. To secure the terminal block structure 125 to the support structure 110, a surface of the terminal block structure 125 is placed against a surface of the support structure 110 with the fastener receiving openings in alignment, and a fastener (e.g., threaded bolt, rivet) (not shown) is inserted through the fastener receiving openings. Then, a threaded nut (not shown) may be threaded onto the end of the fastener and tightened to secure the terminal block structure 125 to the support structure 110. The tab 161 may be oriented to be at a right (90°) angle with respect to the first side portion 113 and/or the second side portion 114 of the support structure 110 (see FIG. 13B).

Figure 14B:
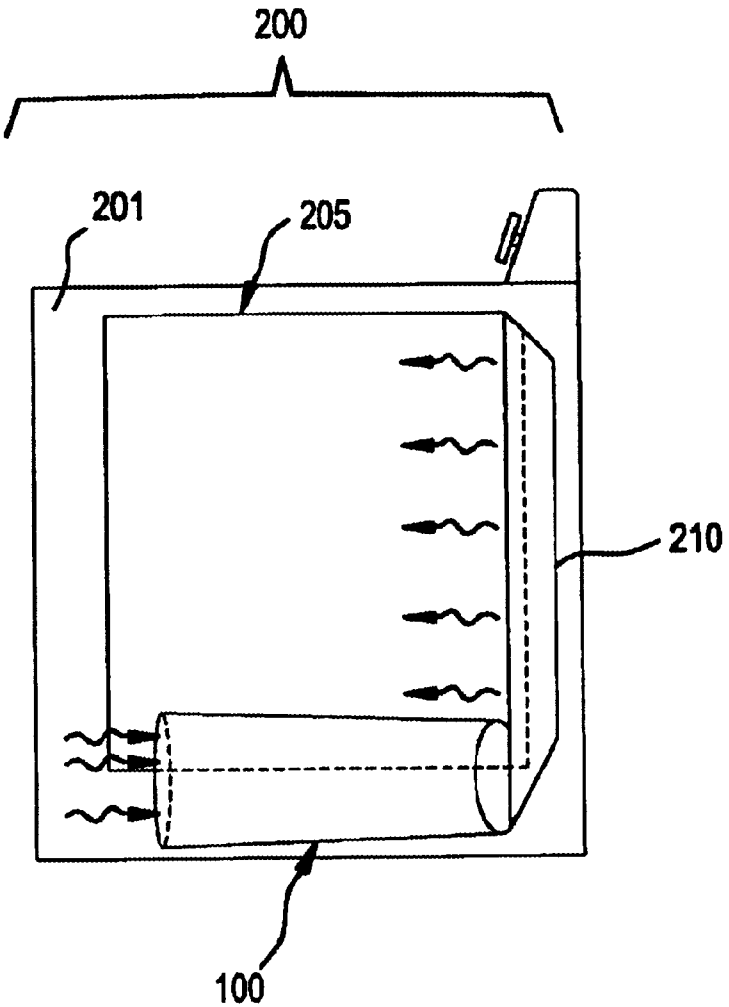
FIGS. 14A and 14B are a front view and a side view, respectively, of the embodiment of FIG. 1 or 9, coupled to a dryer.
Figure 14A:
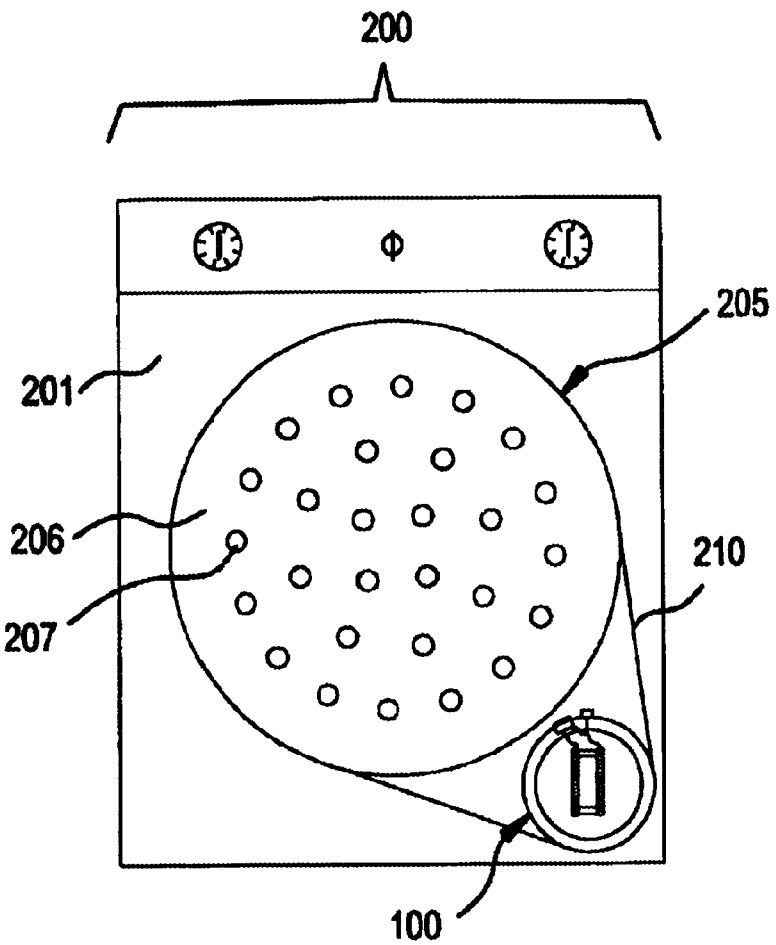

FIGS. 14A and 14B illustrate a front view and a side view, respectively, of the embodiment of FIG. 1 or 9 coupled to a dryer 200. The heater assembly 100, however, may be used with other equipment as well. The dryer 200 may include a dryer housing 201, a drum 205, a duct 210, and a heater assembly 100. The drum 205, the duct 210, and the heater assembly 100 may be positioned within the dryer housing 201. Also, the drum 205 and the heater assembly 100 may both be coupled to the duct 210. The drum 205, constructed and arranged to rotate, may include a stationary back portion 206, where the back portion 206 may include air (e.g., hot air) receiving openings 207 formed therethrough.

Air (denoted by squiggly arrows in FIG. 14B) may be drawn, using a blower (not shown), into the heater assembly 100 to be heated (e.g., electrically heated) and delivered, through the duct 210, to the drum 205. As such, the duct 210, coupled to the heater assembly 100, may receive the heated air from the heater assembly 100. In turn, the drum 205, coupled to the duct 210, may receive the heated air from the duct 201 through the air receiving openings 207.

Some dryers (e.g., clothes dryers) require that the end portion of the housing structure 105, coupled directly or indirectly to the duct 210 and the drum 205, to be smaller, for example, in area than the other end portion of the housing structure 105 that receives air (e.g., unheated air) to be delivered as heated air to the drum 205. The housing structure 105 alone, however, may be used in such dryers since one end portion of the housing structure 105 may be constructed and arranged to be smaller than the other end portion of the housing structure 105 (see described embodiments above, illustrated in FIGS. 1 and 9). As such, the housing structure 105 is not required to be coupled to a transition structure, constructed and arranged to be made part of or be a separate part of the housing structure 105, to satisfy such a requirement from manufacturers of dryers.

As a result, the housing structure 105 may be constructed and arranged to be more efficient and effective in design, construction, and costs, among others. For example, the shape for the housing structure 105 having an inlet area, positioned at one end of the housing structure 105, larger than an exit area, positioned at another end of the housing structure 105, may be constructed and arranged, for example, using a simple tool (e.g., rolling tool), and, for example, not using specialized tools or dies, used presently to form and stretch the metal of known heater housings. Also, the housing structure 105, having the inlet area larger than the exit area, may be constructed and arranged to provide a larger volume of space, for example, for a support structure 110, an insulator structure 115, and/or a heating structure 120 to occupy therein than known heater housings. As such, more space may be available for the heating structure 120 than for known heater housings to lessen present electrical clearance concerns.

Then, the foregoing presentation of the described embodiments is provided to enable any person skilled in the art to make or use the present invention. Various modifications to these embodiments are possible, and the generic principles presented herein may be applied to other embodiments as well. As such, the present invention is not intended to be limited to the embodiments shown above, and/or any particular configuration of structure but rather is to be accorded the widest scope consistent with the principles and novel features disclosed in any fashion herein.

What is claimed is:

1. A heater assembly comprising:

a housing structure constructed and arranged to convey heat to be produced within the housing structure from a first portion of the housing structure to a second portion of the housing structure;

a support structure constructed and arranged to be releasably and fixedly secured to the housing structure;

an insulator structure affixed to the support structure to be releasably and fixedly secured to the housing structure; and a heating structure affixed to the insulator structure to be releasably and fixedly secured to the housing structure, and to be insulated from at least one of the housing structure and the support structure, wherein the housing structure includes an outer surface having a non-uniform cross section with respect to an axis of the housing structure, and wherein the support structure, the insulator structure, and the heating structure are positioned within the housing structure.

2. The heater assembly of claim 1, wherein the outer surface of the housing structure includes a cone shaped cross section.

3. The heater assembly of claim 1, wherein the heating structure includes a resistive heating structure.

4. The heater assembly of claim 3, wherein the resistive heating structure includes a resistive heating coil.

5. The heater assembly of claim 4, wherein the resistive heating coil is helical wound.

6. The heater assembly of claim 5, wherein an axis of the resistive heating coil, being helical wound, is oriented to be perpendicular with respect to the axis of the housing structure.

7. The heater assembly of claim 1, further comprising a terminal block structure constructed and arranged to be releasably and fixedly secured to the housing structure; and a terminal structure, having a first end and a second end, coupled to the heating structure at the first end of the terminal structure and to the terminal block structure at the second end of the terminal structure.

8. The heater assembly of claim 1, wherein at least one of the housing structure and the support structure includes a projection for interlocking with the other of the housing structure and the support structure such that the support structure is releasably and fixedly secured to the housing structure.

9. The heater assembly of claim 8, wherein the projection of the support structure includes a tab, and wherein the projection of the housing structure includes a tab receiving opening, constructed and arranged to receive the tab.

10. The heater assembly of claim 1, wherein the insulator structure is made of ceramic.

11. The heater assembly of claim 1, wherein the insulator structure includes a first heating structure receiving opening and a second heating structure receiving opening, and wherein the heating structure is affixed to at least one of the first heating structure receiving opening and the second heating structure receiving opening of the insulator structure to be releasably and fixedly secured to the housing structure.

12. The heater assembly of claim 11, wherein the support structure includes a first side portion and a second side portion, and wherein the first heating structure receiving opening of the insulator structure is positioned to be adjacent to the first side portion of the support structure and the second heating structure receiving opening of the insulator structure is positioned to be adjacent to the second side portion of the support structure.

13. The heater assembly of claim 12, wherein the support structure includes a heating structure transitioning opening, constructed and arranged to transition the heating structure from adjacent to the first side portion to adjacent to the second side portion of the support structure.

14. The heater assembly of claim 1, wherein the support structure includes a first side portion and a second side portion, at least one of the first side portion and the second side portion of the support structure being constructed and arranged to abut the housing structure.

15. The heater assembly of claim 14, wherein one of the first side portion and the second side portion of the support structure entirely abuts the housing structure, and wherein the other of the first side portion and the second side portion of the support structure partially abuts the housing structure.

16. The heater assembly of claim 14, wherein the support structure includes a first insulator structure receiving opening and a second insulator structure receiving opening, each of the first insulator structure receiving opening and the second insulator structure receiving opening being constructed and arranged to receive the insulator structure, and wherein the first insulator structure receiving opening and the second insulator structure receiving opening are oriented to be about an axis parallel with respect to the at least one of the first side portion and the second side portion of the support structure.

17. The heater assembly of claim 1, wherein the support structure includes an insulator structure receiving opening, constructed and arranged to receive the insulator structure.

18. The heater assembly of claim 17, wherein the support structure includes an end portion, and wherein the insulator structure receiving opening includes a side portion, constructed and arranged to be positioned adjacent to the end portion of the support structure.

19. The heater assembly of claim 17, wherein the support structure includes a thermal fatigue controller portion, wherein the thermal fatigue controller portion of the support structure includes the insulator structure receiving opening and a thermal fatigue controller opening, and wherein the thermal fatigue controller opening is constructed and arranged to accommodate expansion and contraction of the support structure due to heating and cooling.

20. The heater assembly of claim 19, wherein the insulator structure receiving opening and the thermal fatigue controller opening are positioned to be adjacent to each other.

21. The heater assembly of claim 19, wherein the support structure includes an end portion, and wherein the thermal fatigue controller portion of the support structure is positioned to be adjacent to the end portion of the support structure.

22. The heater assembly of claim 1, wherein the housing structure is oriented such that the axis of the housing structure is at least one of horizontal and substantially horizontal.

23. The heater assembly of claim 1, wherein the insulator structure includes a side portion, constructed and arranged to be oriented perpendicular to the axis of the housing structure.

24. The heater assembly of claim 23, wherein the support structure includes a first insulator structure receiving opening and a second insulator structure receiving opening, each of the first insulator structure receiving opening and the second insulator structure receiving opening being constructed and arranged to receive the insulator structure, and wherein the first insulator structure receiving opening and the second insulator structure receiving opening are oriented to be about an axis parallel with respect to the axis of the housing structure.

25. The heater assembly of claim 24, wherein the side portion of the insulator structure is constructed and arranged to be oriented centered about the axis parallel with respect to the axis of the housing structure.

26. The heater assembly of claim 1, wherein at least one of the support structure and the insulator structure includes a projection for interlocking with the other of the support structure and the insulator structure such that the insulator structure is affixed to the support structure to be releasably and fixedly secured to the housing structure.

27. The heater assembly of claim 26, wherein the projection of the support structure includes a tab, and wherein the projection of the insulator structure includes a tab receiving opening, constructed and arranged to receive the tab.

28. The heater assembly of claim 1, wherein the housing structure includes a first area at the first portion of the housing structure and a second area at the second portion of the housing structure, and wherein one of the first area and the second area is a larger area than the other one of the first area and the second area.

29. The heater assembly of claim 28, wherein the first portion of the housing structure includes a first end portion of the housing structure, wherein the second portion of the housing structure includes a second end portion of the housing structure, and wherein the first area at the first end portion of the housing structure is a larger area than the second area at the second end portion of the housing structure.

30. A heater assembly comprising:

a housing structure constructed and arranged to convey heat to be produced within the housing structure from a first end portion of the housing structure to a second end portion of the housing structure;

an insulator support structure constructed and arranged to be releasably and fixedly secured to the housing structure; and a heating coil affixed to the insulator support structure to be releasably and fixedly secured to the housing structure, and to be insulated from the housing structure, wherein the housing structure includes a first area at the first end portion of the housing structure and a second area at the second end portion of the housing structure, wherein one of the first area and the second area is a larger area than the other one of the first area and the second area, and wherein the insulator support structure and the heating coil are positioned within the housing structure.

31. The heater assembly of claim 30, wherein the first area at the first end portion of the housing structure is a larger area than the second area at the second end portion of the housing structure.

32. The heater assembly of claim 30, wherein the housing structure includes an outer surface having a cone shaped cross section.

33. The heater assembly of claim 30, wherein the insulator support structure includes a support structure and an insulator structure.

34. The heater assembly of claim 33, wherein the support structure is releasably and fixedly secured to the housing structure, and wherein the insulator structure is affixed to the support structure to be releasably and fixedly secured to the housing structure.

35. The heater assembly of claim 30, wherein the heating coil is helical wound.

36. The heater assembly of claim 35, wherein an axis of the heating coil, being helical wound, is oriented to be perpendicular with respect to an axis of the housing structure.

37. The heater assembly of claim 30, wherein the insulator structure includes a side portion, constructed and arranged to be oriented perpendicular to an axis of the housing structure.

38. The heater assembly of claim 30, wherein the housing structure is oriented such that an axis of the housing structure is at least one of horizontal and substantially horizontal.

39. A method for assembling a heater comprising:

affixing an insulator structure to a support structure;

affixing a heating structure to the insulator structure; and securing the support structure to a housing structure, wherein the support structure, the insulator structure, and the heating structure are constructed and arranged to be releasably and fixedly secured to the housing structure, and to be positioned within the housing structure, wherein the insulator structure is constructed and arranged to insulate the heating structure from at least one of the housing structure and the support structure, and wherein the housing structure, including an outer surface having a non-uniform cross section with respect to an axis of the housing structure, is constructed and arranged to convey heat to be produced within the housing structure from a first portion of the housing structure to a second portion of the housing structure.

40. The method of claim 39, wherein the outer surface of the housing structure includes a cone shaped cross section.

41. The method of claim 39, wherein the heating structure includes a resistive heating coil.

42. The method of claim 41, wherein the resistive heating coil is helical wound.

43. The method of claim 42, wherein an axis of the resistive heating coil, being helical wound, is oriented to be perpendicular with respect to the axis of the housing structure.

44. The method of claim 39, further comprising securing a terminal block structure to at least one of the housing structure and the support structure; and coupling a terminal structure, having a first end and a second end, to the heating structure at the first end of the terminal structure and to the terminal block structure at the second end of the terminal structure, wherein the terminal block structure is constructed and arranged to be releasably and fixedly secured to the at least one of the housing structure and the support structure.

45. The method of claim 39, further comprising orienting the housing structure such that the axis of the housing structure is at least one of horizontal and substantially horizontal.

46. The method of claim 39, further comprising orienting the insulator structure, including a side portion, such that the side portion of the insulator structure is perpendicular to the axis of the housing structure.

47. The method of claim 39, wherein the housing structure includes a first area at the first portion of the housing structure and a second area at the second portion of the housing structure, and wherein one of the first area and the second area is a larger area than the other one of the first area and the second area.

48. The method of claim 47, wherein the first portion of the housing structure includes a first end portion of the housing structure, wherein the second portion of the housing structure includes a second end portion of the housing structure, and wherein the first area at the first end portion of the housing structure is a larger area than the second area at the second end portion of the housing structure.

49. The method of claim 39, further comprising rolling a portion of heat conducting material to form the housing structure, wherein the housing structure is made of the portion of heat conducting material.

* * * * *